United States Patent [19]

Verstraeten

[11] Patent Number: 4,684,128

[45] Date of Patent: Aug. 4, 1987

[54] GRAB FOR SLOT MACHINES

[75] Inventor: Achiel Verstraeten, Sint-Niklaas, Belgium

[73] Assignee: Elektro Automaten Verstraeten p.v.b.a., Sint Niklaas, Belgium

[21] Appl. No.: 850,318

[22] Filed: Apr. 10, 1986

[30] Foreign Application Priority Data

Apr. 26, 1985 [BE] Belgium ..... 2/60673

[51] Int. Cl.[4] ..... A63F 9/00

[52] U.S. Cl. ..... 273/1 GC; 212/147; 221/210; 273/1 GG

[58] Field of Search ..... 273/1 G, 1 GC, 1 GD, 273/1 GG; 212/147, 213; 221/210

[56] References Cited

U.S. PATENT DOCUMENTS 2,224,906 12/1940 Fraula ..... 212/147
2,600,849 6/1952 Collins et al. ..... 221/210 X
2,916,162 12/1959 Gercke ..... 212/147

FOREIGN PATENT DOCUMENTS 214356 10/1984 German Democratic Rep. ..... 212/213
471278 9/1975 U.S.S.R. ..... 212/213
1062173 12/1983 U.S.S.R. ..... 212/213

*Primary Examiner*—Paul E. Shapiro
*Attorney, Agent, or Firm*—Jordan and Hamburg

[57] ABSTRACT

In a slot machine having a cabinet in which a grab is suspended by means of cable from a crab which can move in various directions, the grab being capable of picking up prizes from a surface over which the grab is suspended, swinging of the grab during movement and directional changes of the crab and tipping of the grab upon picking up of a prize is restricted by means of a tube through which the cable passes.

4 Claims, 2 Drawing Figures

GRAB FOR SLOT MACHINES

BACKGROUND OF THE INVENTION AND RELATED ART STATEMENT

The invention is for a grab for a slot machine. The slot machine primarily comprises a sealed cabinet with a window glass, a layer of a material or carpet on the bottom of the cabinet, prizes of different value arranged on the carpet, a moving crab which can move in various directions installed in the cabinet above the said prizes. A grab for picking up the prizes is suspended from the crab by means of a cable. The grab can be raised and lowered by the cable, which runs through a tube freely suspended in the crab. There is an opening in the cabinet for withdrawal of any prizes which may be picked up by the grab.

It has been observed, heretofore, that when the grab reaches the bottom after its downward movement, it may tip to thereby restrict the chances of picking up a prize. Similarly, these chances are limited by the swinging motion of the grab during the movement of the crab, the grab being suspended from the crab, and during changes of direction of movement of the crab.

OBJECT AND SUMMARY OF THE INVENTION

The object of the invention is to reduce disadvantages and to increase the chances of picking up an object. According to the first characteristic of the invention, the grab is provided with a tubular extension in the center thereof, through which the elevating cable of the grab extends. A crane type slot machine which utilizes the grab of the present invention is fully explained in a U.S. patent application entitled "Device for Carrying the Grab in Slot Machine Cabinets", which was filed in the U.S. Patent and Trademark Office on the same date has the same inventors and assignee as the present application. The contents of the copending application are hereby incorporated in the present application by reference.

DETAILED DESCRIPTION OF PREFERRED EMBODIMENTS

Figure 1:
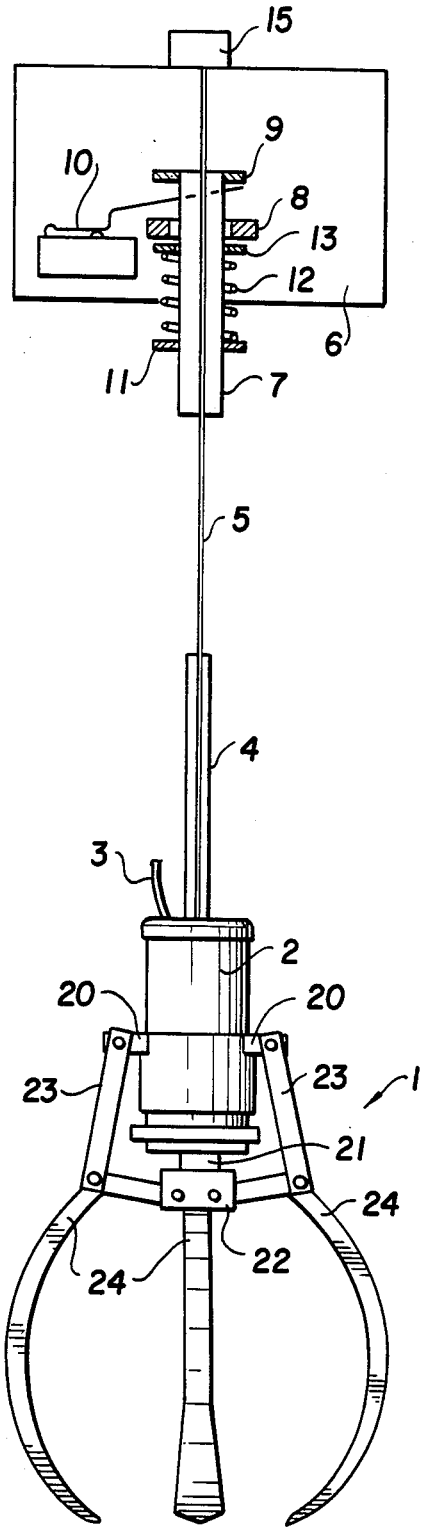
FIG. 1 shows a grab with a tubular extension.

In FIG. 1, it may be noted that a grab 1 is provided with a casing 2 for a solenoid coil, to which electricity is supplied through an electric wire 3. The casing 2 includes three projections 20 extending radially outwardly therefrom and spaced apart at the same interval around the casing 2. The solenoid coil in the casing 2 includes a rod 21 with an end portion 22. When the solenoid coil is actuated, the rod 21 is moved upwardly. On the contrary, when the solenoid coil is not actuated, the rod 21 is located at the lower position due to its own weight.

Pivotally attached to each projection 20 is an arm 23. An arm 24 pivotally connected to the end portion 22 at one end is also pivotally connected to the arm 23. Accordingly, when the solenoid coil is actuated to place the end portion 22 at the upper position, the free ends of the arms 23 are located close to the central axis of the casing 2. In this position, a prize can be grabbed by the arms 23. When the solenoid coil is not actuated, the end portion 22 is located at the lower position, so that the free ends of the arms 23 are located away from the central axis of the casing 2.

The grab is also provided with a tubular extension, for example a hollow pipe 4 being about 7 cm in length, through which a cable 5 extends for raising and lowering the grab 1. This cable is attached at one end to the casing 2 and at the other end to a raising mechanism 15 installed in a crab 6. The crab 6 is free to move in two directions inside a traveller (not shown), which can be moved in the direction perpendicular to the movement of the crab 6.

In this crab, a hollow tube 7 is installed in a known way so that the tube 7 can be vertically freely moved in a guide 8 suspended from the crab 6. The internal diameter of the hollow tube 7 is greater than the external diameter of the hollow tube 4, so that in the highest position of the grab 1, the tube 4 slides into the tube 7. At the upper end of the tube 7, a ring 9 is fastened which rests on a switch 10. The purpose of the switch 10 will be explained hereinafter.

At the lower end of the tube 7, a ring 11 is also installed on which a pressure spring 12 rests. The other end of the spring 12 abuts against a ring 13 freely mounted around the hollow tube 7. This spring absorbs the shocks when the grab 1 is brought to its highest position.

When the grab 1 is lowered by the cable 5 so that it rests on the bottom of the cabinet, the grab 1 has the tendency to tilt. This tilting motion is, however, limited by the tubular extension or hollow tube 4 of the grab 1, because the upper part of this tube 4 presses against the taut cable 5. Similarly and in the same way, when the grab 1 is raised and the crab from which the grab is suspended is moved, the swinging motion of the grab is restricted. This allows the player to profit more from his skill and be less dependent on the luck factor.

Figure 2:
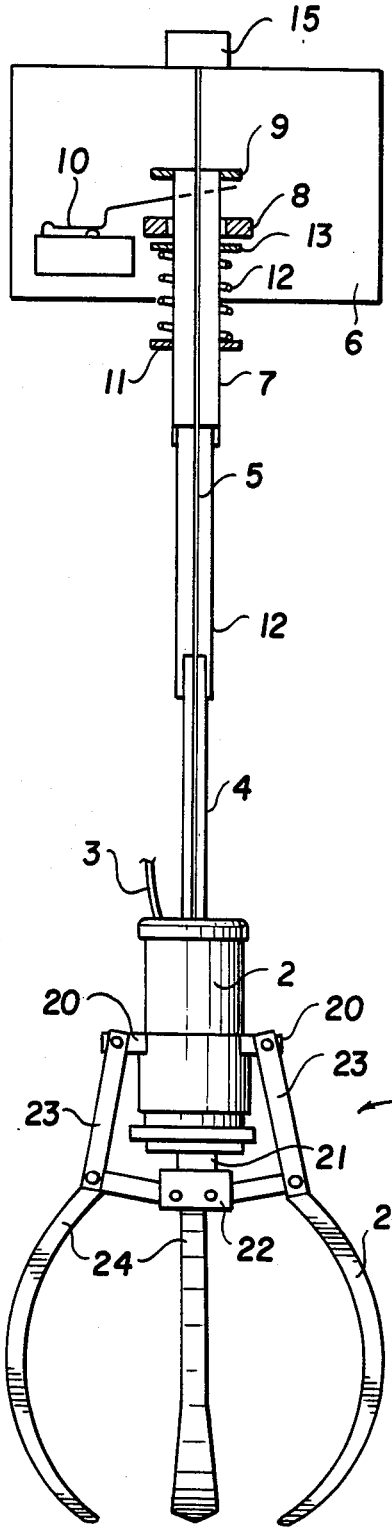
FIG. 2 shows a grab extended by means of a set of telescopic tubes.

In FIG. 2, it can be seen that in this case the grab 1 is also provided with a hollow tube 4, which cooperates with a telescopic tube 12 suspended from the tube 7 supported by the crab. Namely, the tube 7 includes an inner flange at the bottom end, while the tube 12 includes an outer flange at the upper end. The flange of the tube 12 rests on the flange of the tube 7. The cable 5 for raising and lowering the grab 1 passes through the tubes 4, 7 and 12. The same result is achieved with this arrangement as with that illustrated in FIG. 1.

In the slot machine using the crab of the invention, when a user inserts a coin, the crab 6 and the traveller where the crab 6 is installed can be moved inside a cabinet in response to operation of the machine by the user. When the movement of the crab 6 and the traveller has been completed, the grab 1 is automatically moved downwardly. When the grab 1 is moved to a lower position, the solenoid is actuated thereby to move the arms 24 to catch a prize by means of the arms 24. Then, the grab 1 is moved to an upper position, whereby the switch 10 is actuated to stop the movement of the grab 1 and to bring the crab and the traveller back to the first position. Finally, the solenoid is operated to open the arms 24. If a prize was grabbed, the prize falls into an opening, so that the user can obtain the prize.

While the invention has been explained with reference to specific embodiments of the invention, the description is illustrative and the invention is limited only by the appended claims.

What is claimed is:

1. A device for stably supporting a grab from a crab of a crane type slot machine, comprising:

a crab adapted to be moved inside the slot machine, said crab having a cable and means for raising and lowering the cable; and a grab including a casing for a solenoid coil, said casing being connected to a lower end of the cable, a plurality of arms adapted to grab a prize inside the slot machine, said arms being pivotally connected to the casing, and a first hollow tube connected to the casing for surrounding the cable so that the grab does not extremely incline when the grab holds a prize and does not swing when the crab moves inside the slot machine.

2. A device according to claim 1, in which said crab further includes a guide connected to the crab, a second hollow tube having upper and lower rings and an inner diameter slightly larger than an outer diameter of the first hollow tube, said second hollow tube being slidably supported by the guide, and a spring situated between the lower ring and the guide so that when the grab is raised to place the first hollow tube inside the second hollow tube, the spring actuates to gently stop the movement of the crab.

3. A device according to claim 2, further including at least one middle hollow tube telescopically located inside the second hollow tube when the grab is located at an upper position and suspended by the second hollow tube when the grab is located at a lower position.

4. A device according to claim 3, in which said crab further includes a switch situated between the upper ring and the guide so that when the grab is raised and lifts the second hollow tube, the switch is actuated to stop the movement of the grab and to move the crab to an initial position in the slot machine.

* * * * *